United States Patent [19]

Bauer

[11] 4,409,998

[45] Oct. 18, 1983

[54] HAIRSTYLING APPLIANCE

[76] Inventor: Rudolf Bauer, Königstrasse 17, D-7000 Stuttgart 1, Fed. Rep. of Germany

[21] Appl. No.: 320,802

[22] Filed: Nov. 12, 1981

[30] Foreign Application Priority Data

Nov. 18, 1980 [DE] Fed. Rep. of Germany ..... 3043470

[51] Int. Cl.[3] ..... A45D 24/00

[52] U.S. Cl. ..... 132/9; 132/11 A; 132/34 R; 132/34 A; 34/96

[58] Field of Search ..... 132/9, 11 A; 34/96, 34/3, 101

[56] References Cited

U.S. PATENT DOCUMENTS 3,863,652 2/1975 Scivoletto ..... 132/11 A
3,894,547 7/1975 Scivoletto ..... 132/9

FOREIGN PATENT DOCUMENTS 1782830 7/1973 Fed. Rep. of Germany ..... 132/9
2754304 7/1979 Fed. Rep. of Germany .

*Primary Examiner*—C. Fred Rosenbaum
*Assistant Examiner*—Sherri Vinyard
*Attorney, Agent, or Firm*—Edwin E. Greigg

[57] ABSTRACT

There is proposed a hairstyling appliance which has a hair curler cylinder and a hot-air nozzle. The hair curler cylinder is provided with slits; its interior communicates with an air-aspirating device. The hot-air nozzle is directed toward the surface of the hair curler cylinder. Hot air generated by a dryer also provided in the appliance flows from this hot-air nozzle. Upon rotation, the hair curler cylinder takes up the hair and winds it up as a result of the underpressure prevailing at its slits. The hair is then held in the wound-up position, while it is subjected to the flow from the hot-air nozzle. The air, after absorbing water vapor upon passing through the hair, is simultaneously aspirated away from the interior of the hair curler cylinder. The hot-air nozzle is disposed on the appliance at a predetermined, fixed distance from the hair curler cylinder.

9 Claims, 11 Drawing Figures

HAIRSTYLING APPLIANCE

BACKGROUND OF THE INVENTION

The invention relates to a hairstyling appliance having a hot-air nozzle and a device for manipulating the hair, the latter having a hollow body provided with openings and communicating with an air-suction device.

In a known hairstyling appliance of this kind (German Pat. No. 27 54 304), the intake line of a hair dryer is connected with a brush by way of a flexible hose; during drying, the hair is held by this brush. The brush body is embodied as a hollow tube closed at the end and provided with openings. The hose, which communicates with the intake line of the dryer, is attached to this tube. A manner of closed circuit is thus formed, in order that the air blown onto the hair from the output side of the dryer will be reaspirated by the dryer at the intake side again, by way of the openings in the brush core. The hairdresser holds the dryer in one hand and the brush in the other. The air, circulated between the dryer and the brush through the blower, is rapidly saturated with water vapor, whereupon effective drying no longer takes place.

OBJECT AND SUMMARY OF THE INVENTION

It is accordingly a principal object of the invention to create a hairstyling appliance, of the general type described at the outset, which makes it possible to roll up the hair, shape it, damp-dry and dry it. The appliance should be manipulatable using only one hand, and it should enable more rapid work.

This object is attained in that the device intended to roll up, shape, damp-dry and dry the hair is embodied by a hair curler cylinder driven in a rotary direction and having the openings mentioned above as well as a surface on which the hair is to be placed, and the hot-air nozzle is disposed at a predetermined distance from the hair curler cylinder.

Because the hair curler cylinder provided with slits rotates, the hair comes to rest on the surface of this curler cylinder. That is, the hair curler cylinder takes up the hair as a consequence of the suction effect of the rotating slits, and the hair is then held in place in the rolled shape. In this position, hot air blows onto the hair, flows through the hair and is reaspirated from the interior of the hair curler cylinder; this is effected without circulating the air so as to cause saturation of the air with water vapor, because the operations of aspirating air and of preparing the hot air are separate. Because of the distance between the hot-air nozzle and the hair curler cylinder, which is predetermined by the appliance, one is prevented from approaching too closely to the hair with the hot-air nozzle and thereby damaging the hair. The new hairstyling appliance thus brings about safer hair handling on the one hand and more rapid drying on the other. At the same time, there are new opportunities for shaping the curls. Because the appliance can be manipulated with only one hand, the hairdresser has the opportunity to use the other hand for performing other operations on the hair.

The hair curler cylinder is preferably insertable in the hairstyling appliance, so that curlers of various sizes and properties can be inserted. In accordance with an advantageous further embodiment of the invention, the drive of the hair curler cylinder is effected via a slip-coupling (that is, wheels effecting a friction lock in the drive mechanism). The friction is adjusted such that there is no unpleasant or undesirable pull exerted on the hair. This slip-coupling can be actuated by an actuation lever on the hand grip. By varying the hand pressure, the drive of the hair curler cylinder can be regulated from zero up to some predetermined value.

In an advantageous manner, the surface of the hair curler cylinder is smoothly polished. The hair then slides along this surface as soon as it has been wound up on it. Pins can also be provided on the surface of the hair curler cylinder in order to assure a particular orientation of the hair on the hair curler cylinder.

In terms of its construction, a preferred exemplary embodiment of the invention provides for a U-shaped appliance; the hair curler cylinder is rotatable on one arm of the U and the hot-air nozzle is disposed on the other arm of the U.

In terms of its drive means and its air supply, the dryer which provides the supply of hot air to the hot-air nozzle is independent from the air aspirating device which communicates with the interior of the hair curler cylinder. It is preferably provided that the hot air generated by the dryer is emitted in a direction that is axially parallel to the hair curler cylinder, and that the hot air is deflected in the hot-air nozzle toward the surface of the hair curler cylinder.

An advantageous further embodiment of the invention provides that the hot-air nozzle flows onto the hair wrapped on the hair curler cylinder at a tangent, moving in the direction from the root to the tip of the hair. It has been demonstrated that when the air is blown against it in this direction, the hair gains a particular sheen, because the scales on the surface of the hairs are made to fit tightly against one another. In accordance with the two rotary directions of the hair curler cylinder, two different positions are also possible for the hot-air nozzle; an electric coupling is preferably provided, so that when the hot-air nozzle is pivoted, the rotary direction of the hair curler cylinder will be reversed at the same time.

The invention will be better undestood and further objects and advantages thereof will become more apparent from the ensuing detailed description of a preferred embodiment taken in conjunction with the drawings.

DESCRIPTION OF THE PREFERRED EMBODIMENT

Figure 1:
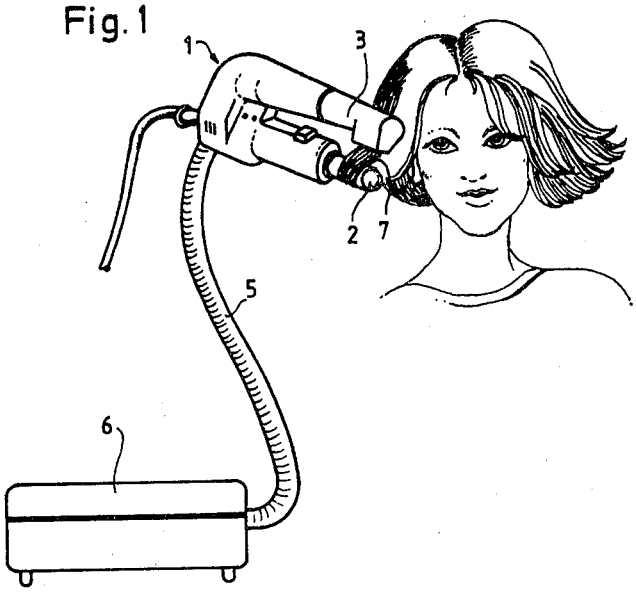
FIG. 1 is a schematic illustration showing the manipulation of an exemplary embodiment.
Figure 2:
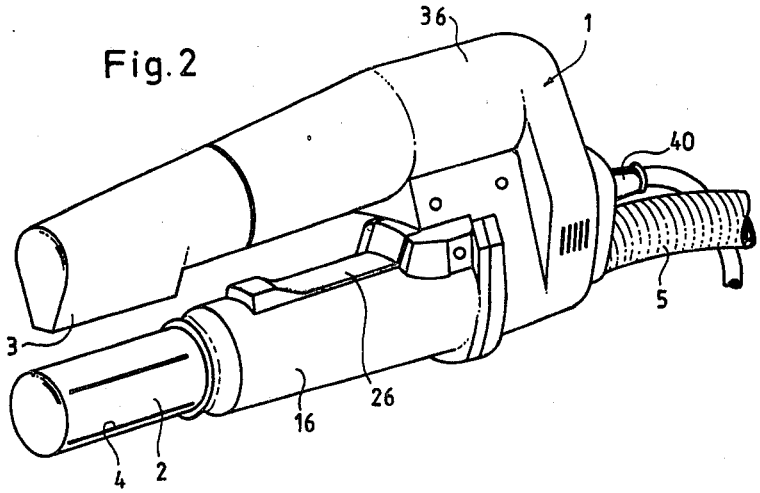
FIG. 2 is a perspective view of the exemplary embodiment (without the air-aspirating device)

As may be seen in FIG. 1, the hairstyling appliance has a housing 1, a rotary-driven hair curler cylinder 2 and a hot-air nozzle 3. The hair curler cylinder 2 has air intake slits 4 and communicates via a hose 5 with an air-aspirating device 6. This device is embodied similar to the suction device of a vacuum cleaner; that is, it is substantially embodied by a blower of appropriate force.

If the appliance is embodied in compact form for personal use in the home, then the air-aspirating device may be accommodated on the housing, for instance at the rear.

Because of the underpressure existing at the air intake slits 4 of the hair curler cylinder 2, the hair, or a strand of hair 7, adheres to the surface of the rotating hair curler cylinder and is taken up thereby or wound thereon. At the same time, a flow of hot air onto the wound hair is effected from the direction of the hot-air nozzle 3. The strand of hair 7 is accordingly both dried and well curled at the same time.

Figure 3:
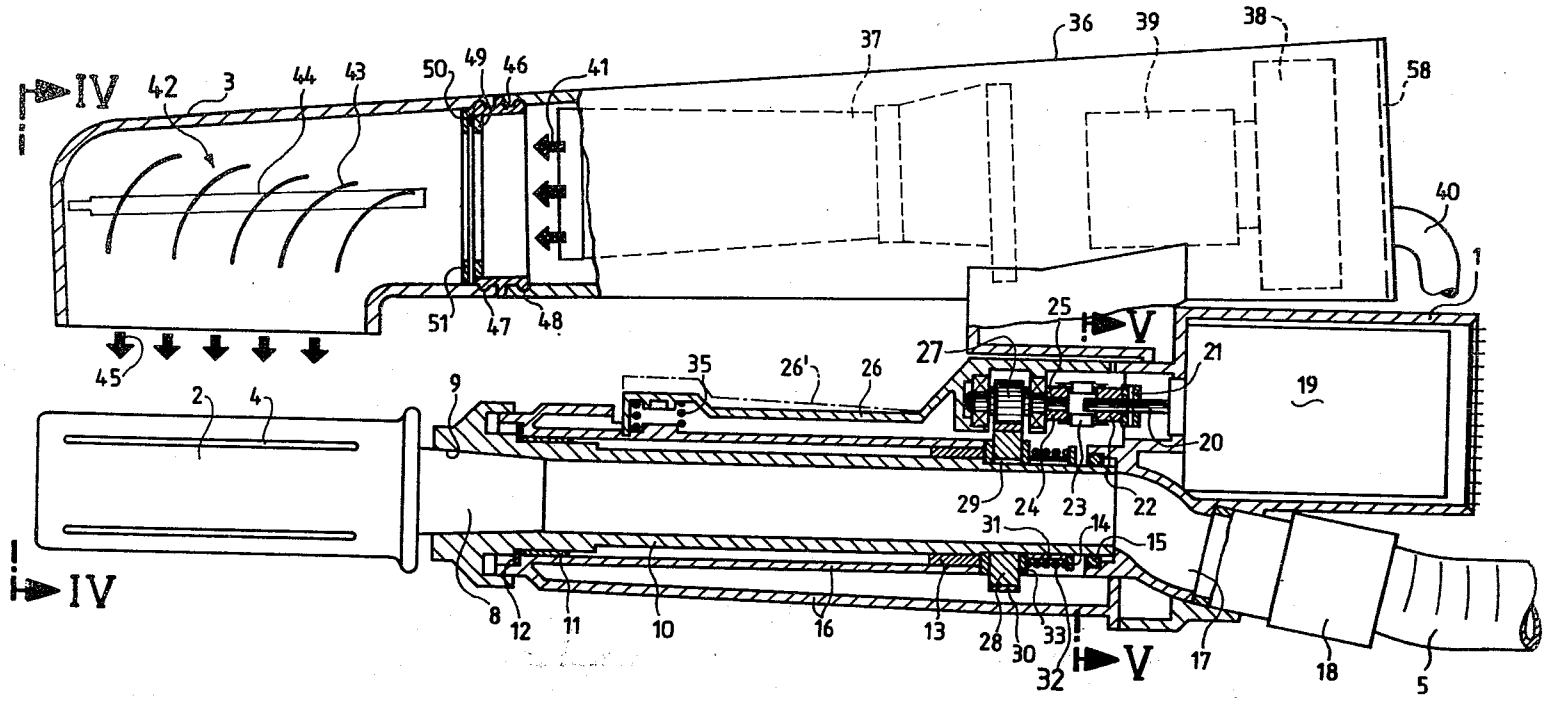
FIG. 3 is a section taken through the exemplary embodiment.
Figure 4:
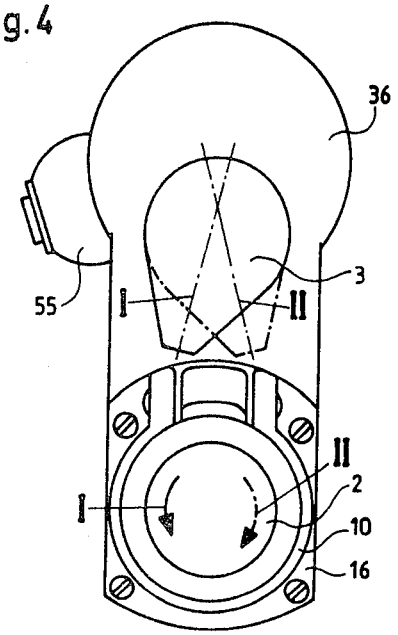
FIG. 4 is a view of the exemplary embodiment in the direction of the arrows IV—IV in FIG. 3.

The construction of the appliance is shown in greater detail in FIGS. 3 and 4. As may be seen, the hair curler cylinder 2 provided with the air intake slits 4 is closed at its end. The surface is smoothly polished, so that the hair, once rolled up on the curler, slides along the surface of the hair curler cylinder. On the right-hand side as seen in FIG. 3, the hair curler cylinder 2 is provided with a cone or a frustoconical tubular attachment 8, which is open toward the right. With the cone 8, the hair curler cylinder 2 is inserted in a reception opening 9, embodied in correspondingly conical fashion, of a hollow shaft 10. The hollow shaft 10 is rotatably supported in the hand grip 16, which is part of the housing 1, with the aid of a sleeve 11, an abutment disc 12, a further sleeve 13, a securing ring 14 and a sealing ring 15. The right-hand end of the hollow shaft 10 merges with a hollow line 17 provided in the housing 1; the hose 5 is coupled to this hollow line 17 with the aid of a coupling sleeve 18. An underpressure generated by the air-aspirating device 6 and in effect at the hose 5 is thus exerted at the air intake slits 4 from the interior.

The rotary drive of the hollow shaft 10 is effected by means of a direct-current motor 19. One component of the direct-current motor 19 is its drive shaft 20. The drive shaft is coupled with the sleeve 22 in the rotary direction with the aid of a pin 21. The sleeve 22 is connected via a metal-bellows coupling 23 with a further sleeve 24. This further sleeve 24 is shrink-fitted onto the shaft 25, so that there is a firm connection in the rotary direction between the drive shaft 20 and the shaft 25. This shaft 25 is supported in the actuation lever 26 with the aid of two ball bearings. The shaft 25 is also firmly connected with a drive wheel 27. In the position of the actuating lever 26 shown in FIG. 3, the drive wheel 27 is meshing with the friction wheel 28. This friction wheel 28 is wedged to the hollow shaft 10 with the aid of a wedge and provided with a friction lining 30. Between the securing ring 14, already mentioned, and the friction wheel 28, a spacer sleeve 31, a spring 32 and a presser disc 33 are also provided.

Figure 5:
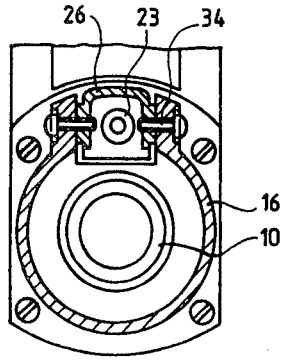
FIG. 5 is a section taken along the line V—V in FIG. 3.

As may be seen from FIG. 5, the actuation lever 26 is pivotably supported in the hand grip 16, in the vicinity of the metal-bellows coupling 23, with the aid of two rotation pins 34. A spring 35 is disposed between a protrusion in the actuation lever 26 and a corresponding protrusion in the hand grip 16, pressing the actuation lever 26 into the position 26′ indicated by dot-dash lines. It can accordingly be pressed from position 26′ into the position indicated by solid lines as well. The pivoting movement thereby occurring is also executed by the unit comprising the sleeve 24, shaft 25 and drive wheel 27, since because of the metal-bellows coupling 23 the connection between this unit and the sleeve 22 is movable. In position 26′, the drive wheel 27 is not connected with the friction wheel 28, so that the hollow shaft 10 is not driven. When the actuation lever 26 is in the position indicated by solid lines, however, the drive wheel 27 is connected to the friction wheel 28, and the hollow shaft 10 is driven. When the appliance is being used, the hairdresser holds the hand grip 16 with one hand and presses on the actuation lever 26 with his fingers. Depending upon whether this pressure is exerted, and with how much force, a more or less firm friction lock exists between the drive wheel 27 and the friction wheel 28. In other words, this connection is a slip-coupling; depending upon whether there is a friction lock and upon how strong it is, the friction wheel 28 is coupled to the drive wheel 27 with more or less slippage, and the hollow shaft 10, and with it the hair curler cylinder 2, is accordingly driven at a higher or lower speed.

It is clear that one skilled in the art can avail himself of various alternative possible realizations of a slip-coupling. The drive unit shown herein is understood to be given solely by way of example.

In the upper portion 36 of the housing 1, there is a dryer 37 with appropriate air-heating devices (not shown), by means of which air is blown from a blower 38. The air is aspirated through intake slits 58 provided in the housing. The supply of electric current to the motor 39, as to the motor 19 as well, is effected via the cable 40.

The air leaves the dryer 37 in the direction indicated by the arrows 41 and enters the hot-air nozzle 3. A deflecting grid 42 is provided in the hot-air nozzle, made up by a plurality of deflecting plates 43 secured on a holder 44. The deflection is effected such that the hot air emitted by the dryer 37 leaves the hot-air nozzle 3 in the direction indicated by the arrows 45.

The hot-air nozzle 3 is pivotably secured on the upper portion 36 of the housing with the aid of a connecting ring 46. The connecting ring is provided with two annular protrusions 47 and 48, which reach behind corresponding shoulders in the upper portion 36 and in the element forming the nozzle. In order to enable these protrusions 47 and 48 to snap into place behind the shoulders, the connecting ring 46 may be slotted in the longitudinal direction at some point on its circumference.

It is further provided that when the hot-air nozzle 3 is pivoted, a reversal of the rotary direction of the electromotor 19 occurs at the same time. This may be realized in the following manner: The connecting ring 46 is embodied such that it is rotatable only relative to the hot-air nozzle 3, but not relative to the upper housing portion 36. This may be attained, for example, by providing that a protrusion of some sort (not shown), provided along the circumference of the annular protrusion 48, snaps into place in a corresponding recess on the upper housing portion 36.

Figure 6A:
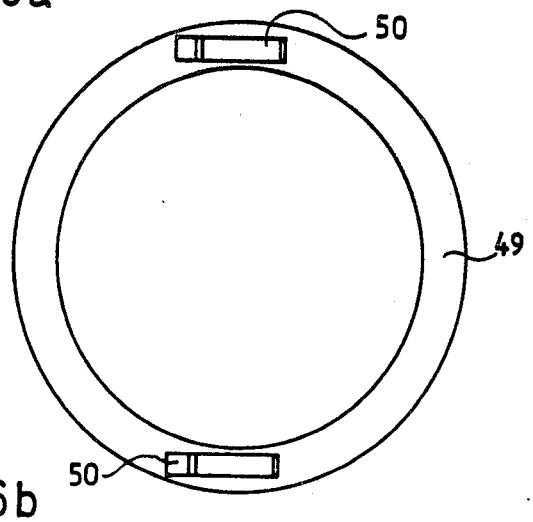
FIGS. 6*a* and 6*b* are a plan view and a lateral view, respectively, of a switching ring 49 such as is used in the exemplary embodiment.
Figure 6B:
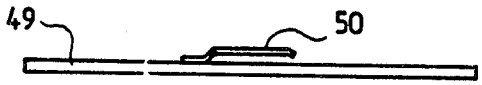
Figure 7A:
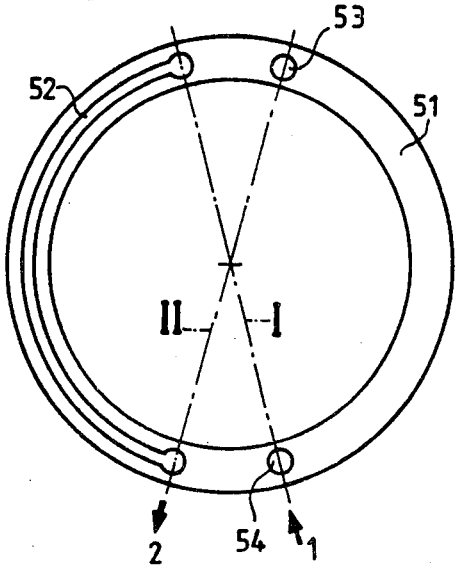
FIGS. 7*a* and 7*b* are a plan view and a lateral view, respectively, of a contact ring 51 such as is used in the exemplary embodiment.
Figure 7B:
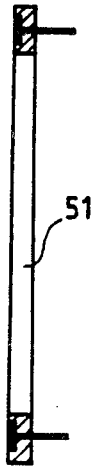

A switching ring 49 is also inserted into the connecting ring 46, as is shown in detail in FIGS. 6*a* and 6*b*.

This switching ring is provided along its circumference with two switching contacts 50 disposed diagonally opposite one another. At the same time, the contact ring 51 shown in FIGS. *7a* and *7b* is inserted into the hot-air nozzle 3. This hot-air nozzle 3 is shown in FIGS. *7a* and *7b* and has a contact path 52 and a contact pin 54. If contact path 52 on the one hand and on the other hand the two contact pins 53 and 54 are connected with the terminals of a voltage source, then this voltage is applied with opposite polarities at the contacts 50 in the rotary positions indicated by I and II in the drawing. The driving motor 19 is then connected to the contacts 50. The rotary direction of the motor 19 thus depends on the position of the hot-air nozzle 3 relative to the upper housing portion 36. It is furthermore provided that the rotary position of the hot-air nozzle 3 on the upper housing portion is limited in some way. The stops which serve this purpose are not, however, shown in FIG. 3, for the sake of simplicity.

The two pivoting positions I and II of the hot-air nozzle 3 are also shown in FIG. 4, with respect to the hair curler cylinder 2. These two pivoting positions are oriented to the direction of rotation of the hair curler cylinder 2, which they effect, in such a way that the hair wound on the hair curler cylinder is subjected to a tangential flow of air from the hot-air nozzle 3, directed toward the tips of the hair. This is expressed in FIG. 4 in that position I and the arrow indicating the associated direction of rotation are represented by solid lines, while position II and the direction of rotation associated with it are indicated by dot-dash lines.

In FIG. 4, a switch 55 is also provided on the upper housing portion 36, serving to switch the motors 39 and 19 on and off. The course of the electrical lines is not shown in detail; however, it is obvious to one skilled in the art how the lines should be arranged, so that this matter needs not be discussed in detail in the present context.

Figure 8:
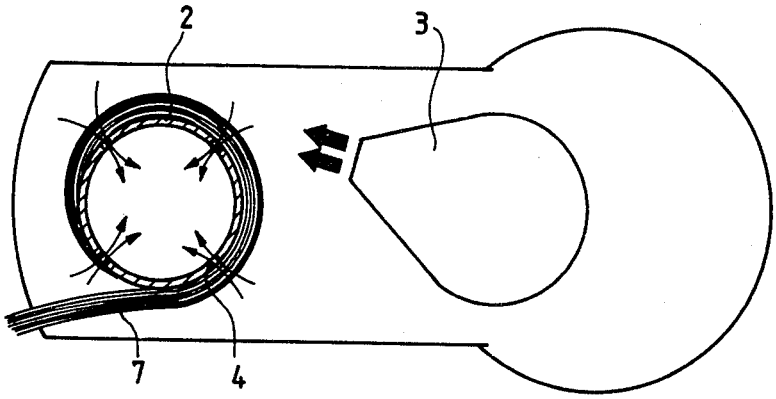
FIG. 8 is a schematic view of air blowing on a strand of hair 7, which is wound up on a hair curler cylinder 2.

FIG. 8 serves to explain the basic functioning of the apparatus. It shows how a strand of hair 7 is wound counterclockwise by the hair curler cylinder 2, in accordance with the directon of rotation of the curler 2. As already noted, excessive tension is not exerted on the strand of hair; this is assured by two provisions:

(a) The surface of the hair curler cylinder is highly polished. As a result, the strand of hair is able to slide on the rotating hair curler cylinder 2 once it has been wound thereon. The tension thereby exerted on the strand of hair as the result of friction with the rotating hair curler cylinder 2 is relatively slight, and it is not perceived as unpleasant.

(b) The slip-coupling between the drive wheel 27 and the friction wheel 28 may be adjusted in such a manner that if the tension on the hair exceeds a predetermined value, the drive wheel 27 slips on the friction wheel 28 and no longer drives the shaft 10. This adjustment also depends upon the force with which the operator presses on the actuation lever 26.

When a strand of hair 7 is first being wound on the curler, it is carried along in the direction of rotation of the hair curler cylinder 2 because the individual hairs are made to rest on the curler in consequence of the underpressure at the air intake slits 4. The hair is then carried along with the rotating curler; because these slits 4 at which the underpressure prevails are rotating, the hair is wound up along the circumference on the curler. In practical terms, the slits 4 are rotating sources of underpressure, disposed along a cylindrical surface, assuring that the hair is taken up, wound, and held in place on the curler.

It is particularly important that, in this position, not only is the hair heated by the hot-air flow coming from the hot-air nozzle 3 and thus dried; in addition, this hot air, which absorbs water vapor upon contact with the hair, is carried away into the interior of the cylinder. In other words, while in the case of hair subjected in conventional fashion to a hot flow of air, a certain amount of drying first takes place on the surface but the water vapor then is re-condensed at a deeper level in the hair, in the invention the hot air is removed after it has absorbed the water vapor. Thus the drying is effected in two ways, by blowing hot air on the hair and by removing the damp air by means of suction. Very much less time is thus required to dry the hair than with a conventional hair dryer.

Optimal opportunity for shaping the curl is provided because the flow of air is directed toward the wound-up strand of hair (a) at a tangent; and (b) in a direction from the root to the tip of the hair; as a result, (c) the hair is held on the hair curler cylinder 2 in the desired shape.

It has been found that this shaping is particularly long-lasting if not only the drying but the cooling down of the hair as well are effected while the hair is in the desired shape. This, too, is attainable with the present invention. To this end, it is necessary solely to shut off the heating of the dryer briefly. This can be done by appropriate switches, not shown for the sake of simplicity, and which can easily be provided by one skilled in the art.

It is also possible to dispose a dampness sensor in the air outflow channel (not shown)—that is, in the path of the air being carried away from the curler—by which the heating of the hair dryer is automatically switched off as soon as the water vapor content of the exhaust air falls below a predetermined value and thus indicates that the hair is dry.

Finally, when this novel hairstyling appliance is used, it is important that because of the manner in which the strand of hair is wound up on the hair curler cylinder 2, even the tips of the hair lie in the desired direction during the entire course of drying.

In comparison with the conventional manner of hair styling, that is, by winding a strand on a comb or brush and then drying it with hot air, the hairstyling appliance according to the invention has the further advantage that a distance predetermined by the structural realization of the appliance is always preserved between the strand of hair and the hot-air nozzle; this prevents the operator from approaching too close to the hair with the dryer, in order to save time, and allowing the surface of the hair to become excessively hot.

Figure 9:
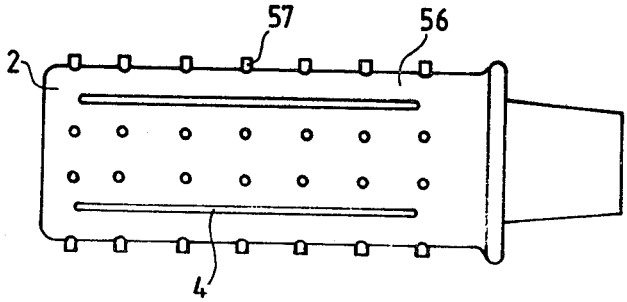
FIG. 9 shows a modification of the hair curler cylinder 2 which may be used in the exemplary embodiment.

FIG. 9 shows a hair curler cylinder 56, which is a modification of the hair curler cylinder 2. The curler 56 differs from curler 2 in that a plurality of rows of pins 57 is provided along its circumference. These pins serve to assure that when hair is wound on the curler, it maintains its relative position along the circumference, perpendicular to the axis of the curler, and does not lie obliquely, even while sliding on the surface of the hair curler cylinder.

Finally, FIG. 9 shows that a plurality of various hair curler cylinders can be provided for a particular hairstyling appliance, differing in size, in the number and dimension of the air intake slits, in length, in circumference, in the characteristics of the curler surface, and so forth. All such curlers can be inserted in to the reception opening 9, as long as the tubular attachments 8 have the same dimensions. A set of hair curler cylinders capable of performing the most various hairstyling tasks can thus be provided.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. Hair styling device comprising:

a housing, a hair curler cylinder, said hair curler cylinder having a smooth outer surface upon which hair is wound and an interior hollow space defined by an end wall, said hair curler cylinder further including openings which extend through said wall to said interior hollow space, driving means for driving said hair curler cylinder for winding hair onto said hair curler cylinder and on which said hair can slip during rotation of said hair curler cylinder, air aspirating means in communication with the hollow interior space of said hair curler cylinder which maintains a continuous air flow from the outer surface of said hair curler cylinder through any hair on said hair curler cylinder and through said openings in said wall into said hollow interior space which effects take-up of hair in a sliding relationship with the outer surface of a rotating hair curler cylinder, a hot air supply means, a hot air supply nozzle which directs a stream of hot air from said hot air supply means relative to said hair curler cylinder, said hot air supply nozzle being pivotable about an axis of said housing to attain one of two set positions which positions function as a switch which controls a direction of rotation of said hair curler cylinder and the direction of the hot air stream relative to said hair curler cylinder, said stream of hot air being in a direction tangential to the circumference of said hair curler cylinder and in a direction of rotation thereof such that the flow of all of the hot air stream is in the rotational direction of the hair curler cylinder, passes through the hair as the hair is wound onto the hair curler cylinder and upon contact of the hot air stream with the hair curler cylinder, the hot air stream follows th curvature of the hair curler cylinder essentially in the same direction as the rotation of said hair curler cylinder, and said hot air stream is aspirated through said openings which extend through the wall of said air curler cylinder to decrease drying time of the hair being styled.

2. A hairstyling appliance as defined in claim 1, characterized in that the openings in the hair curler cylinder have the form of axially parallel slots.

3. A hairstyling appliance as defined by claim 1, characterized in that said hair curler cylinder is provided with a frustoconical attachment on one end which is insertable into a reception opening of a hollow shaft driven by said hair curler cylinder driving means.

4. A hairstyling appliance as defined by claim 1, characterized in that said hair curler cylinder drive means is engaged for driving said hair curler cylinder via a friction clutch.

5. A hairstyling appliance as defined by claim 4, characterized in that said friction clutch is brought into driving engagement by an actuation lever.

6. A hairstyling appliance as defined by claim 1, characterized in that said hair curler cylinder further includes protrusions disposed on the surface thereof.

7. A hairstyling appliance as defined by claim 1, characterized in that said appliance is U-shaped, wherein said hair curler cylinder is partially encompassed by a hand grip means which forms one arm of said U and said hot-air nozzle and a housing portion which cooperates therewith forms the other arm of said U.

8. A hairstyling appliance as defined by claim 1, characterized in that hot air is supplied to said hot-air nozzle by a dryer disposed in said housing, and a supply of fresh air is supplied said dryer independent of said air-aspirating device.

9. A hairstyling appliance as defined in claim 1, characterized by electrical switching means to synchronize a change in position of the hot-air supplying nozzle with a change in direction of rotation of the hair curler cylinder.

* * * * *